US005310189A

United States Patent [19]

Soto

[11] Patent Number: 5,310,189

[45] Date of Patent: May 10, 1994

[54] SOFT GOLF CLUB, TEE AND BALL

[75] Inventor: Jorge Soto, Redwood City, Calif.

[73] Assignee: Mattel, Inc., El Segundo, Calif.

[21] Appl. No.: 14,289

[22] Filed: Feb. 5, 1993

[51] Int. Cl.[5] ..... A63B 69/36

[52] U.S. Cl. ..... 273/193 R; 273/78; 273/33; 273/195 R; 273/199 R; 273/218; 273/DIG. 8

[58] Field of Search ..... 273/203, 81 R, 168, 273/199 R, DIG. 8, 193 R, 194 R, 194 A, 194 B, 195 R, 199 A, 202, 33, 78, 193 A, 193 B; 446/491

[56] References Cited

U.S. PATENT DOCUMENTS

| | | | |
|---|---|---|---|
| 2,555,222 | 5/1951 | Coleman et al. | 273/203 |
| 3,554,543 | 1/1971 | DiLaura | 273/DIG. 8 |
| 3,567,227 | 3/1971 | Panks | 273/168 |
| 3,940,145 | 2/1976 | Gentiluomo | 273/199 X |
| 4,079,936 | 3/1978 | Schacter | 273/DIG. 8 |

FOREIGN PATENT DOCUMENTS

| | | | |
|---|---|---|---|
| 1201648 | 8/1970 | United Kingdom | 273/81 R |

*Primary Examiner*—George J. Marlo
*Attorney, Agent, or Firm*—Roy A. Ekstrand

[57] ABSTRACT

A toy golf playset includes a golf club having an elongated shaft supporting a soft foam handle at one end thereof and a soft foam clubhead at the remaining end. The golf club is formed shorter and thicker than conventional golf clubs. The golf club head defines a pair of equally angled ball hitting surfaces or facets to facilitate use of the golf club by both right-handed and left-handed children. An omnidirectional golf tee defines a quartet of symmetrically positioned generally cylindrical elements each of which joins the remaining elements a common center of intersection and each of which defines a concave ball recess facilitating the positioning of a soft resilient foam ball upon the vertically extending one of the elements when the tee is placed upon a play surface. The golf tee is preferably formed of a resilient soft foam material or the like.

3 Claims, 1 Drawing Sheet

SOFT GOLF CLUB, TEE AND BALL

FIELD OF THE INVENTION

This invention relates generally to toy sport playsets and particularly to golf playsets intended for use by extremely young children.

BACKGROUND OF THE INVENTION

The game of golf has become one of the most popular participation and spectator sports throughout most of the industrial world. Its popularity is relatively easy to understand in that it may be played at virtually any skill level with considerable enjoyment. The benefits of golf as a sport and relation activity are well known. Golf provides beneficial exercise, outdoor activity with plenty of fresh air and usually moves at a relaxing stress-free pace. The apparatus used to play golf is relatively simple in its basic construction. The user employs a plurality of golf clubs each having elongated handles and extending usually cylindrical somewhat flexible shaft portions which terminate in a club head designed to strike the ball. The club heads are subject to substantial specialization in that the material used and interacting club face structure are varied to provide the appropriate club under virtually any condition of play. At the initial points called tees within the golf course, the user generally elevates the ball upon a small raised support known generally as a tee. The ball itself comprises a small very hard and highly elastic ball having a pebbled or dimpled outer surface which is usually formed of a hard rubber or plastic material.

As is well known, children innately desire to imitate or mimic the adult activities and situations which they observe in their surroundings. Sports and games are no exception to this general rule and thus children often desire to imitate or mimic the adults sports activities which they observe. In many ways, the game of golf is an excellent amusement and entertainment activity for young children in that it provides development and improvement of several basic skills. For example, the proper use of the golf club in striking the ball improves hand to eye coordination and manual dexterity. The visual distance and space judgments required to properly engage in the game of golf provide beneficial exercise of the child's spatial judgment and coordinating skills.

However, despite the many benefits to be provided to young children by participation in the game of golf, several safety concerns generally restrict the activity to older children and deny these benefits to younger children. There remains therefore a need in the art for golf playsets which may be safely utilized by very young children without compromising legitimate concerns of safety and injury avoidance. In addition, there remains a further need in the art for such golf playsets which are more appropriate to the limited skill level of young children while nonetheless providing amusement, entertainment and play motivation.

SUMMARY OF THE INVENTION

Accordingly, it is a general object of the present invention to provide an improved toy golf playset. It is a more particular object of the present invention to provide an improved toy golf playset which is suitable for and adapted to use by extremely young children. It is a still further object of the present invention to provide a golf playset which maximizes the safety of golf play for extremely young children.

In accordance with the present invention, there is provided a toy golf playset comprises: a golf club having an elongated shaft, a handle, and a clubhead, the clubhead being formed of a soft resilient foam material; a soft resilient foam ball; and a golf tee having four elements extending radially outwardly from a common center such that each forms equal angles with each remaining elements.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
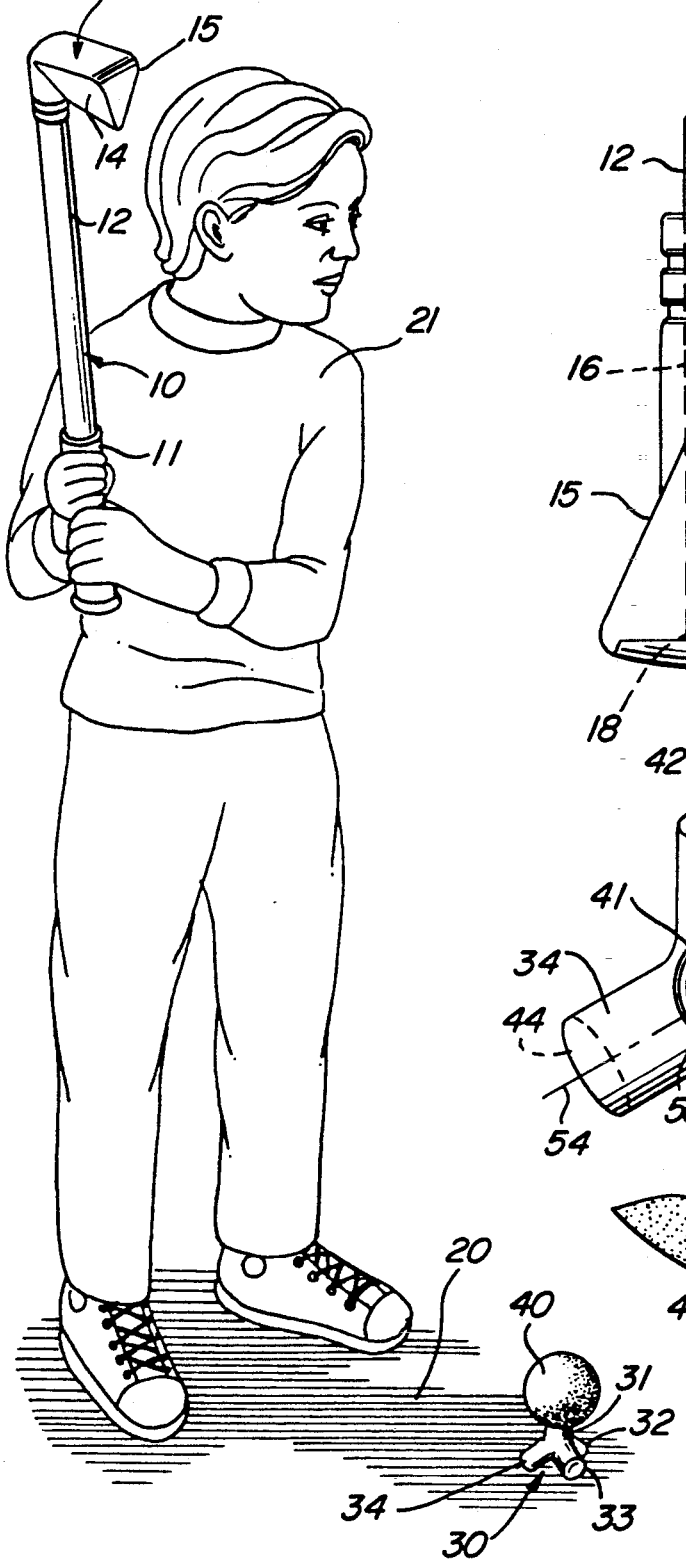
FIG. 1 sets forth a perspective view of the present invention toy golf playset in a typical use.

FIG. 1 sets forth a perspective view of a toy golf playset constructed in accordance with the present invention in a typical play pattern in use by a child user generally referenced by numeral 21. A golf club 10 constructed in accordance with the present invention includes an elongated generally cylindrical soft foam handle 11 coupled to an elongated cylindrical shaft 12. In its preferred form, handle 11 is molded upon shaft 12 to form a secure attachment thereto. Shaft 12 is preferably thicker and shorter than standard golf club shafts and thus is particularly suited to use by small children. Golf club 10 further includes a clubhead 13, the structure of which is set forth in greater detail in FIG. 2. Suffice it to note here, however, that clubhead 13 is preferably fabricated of a soft resilient foam material and defines a pair of equally angled club faces 14 and 15.

A resilient foam ball 40 substantially larger in diameter than a standard golf ball is supported upon a play surface 20 by a omnidirectional golf tee 30. In accordance with an important aspect of the present invention, golf tee 30 is fabricated of a resilient soft foam material and defines four substantially equal length generally cylindrical elements 31, 32, 33 and 34 commonly joined at one end and extending radially outwardly from their common junction such that each element forms an equal included angle with each of the remaining elements which form golf tee 30. As is better seen in FIG. 3, each element 31 through 34 defines a concave ball recess 41 through 44 respectively. Thus, in accordance with a further important aspect of the present invention, golf tee 30 is omnidirectional in that when placed upon a flat play surface, tee 30 is automatically supported by three downwardly angled elements such that the fourth element extends upwardly in a generally perpendicular relationship to the play surface. Thus, regardless of which trio of elements tee 30 rests upon, the remaining or fourth element extends vertically and provides a suitable supporting ball tee. A child user, therefore, need not take care in positioning tee 30 upon play surface 20 but rather may simply drop tee 30 upon the tee surface and the equal angle element structure of tee 30 automatically assures that tee 30 assumes a position such as that shown in FIG. 1. With ball 40 placed upon tee 30, the child user is then able to carry forward a golf-like game play in which golf 10 is swung through an arced swing driving clubhead 13 against ball 40. The use of a resilient soft foam ball 40 together with a soft foam clubhead 13 of golf club 10. The resilient soft material forming tee 30 combines to provide a safe playset which permits the child user to exercise virtually unlimited swing force without fear of injury to the child user and surrounding participants or spectators.

Figure 2:
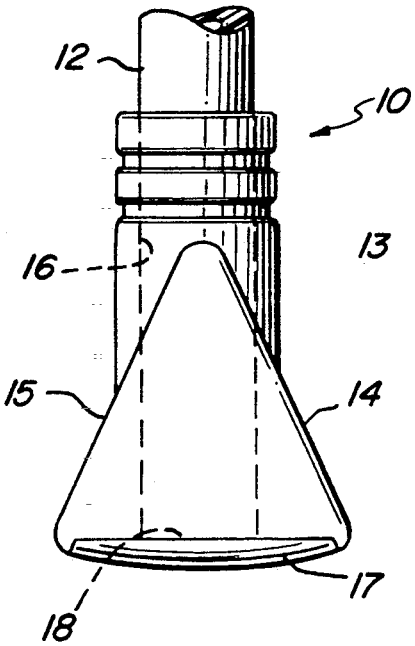
FIG. 2 sets forth a partial section view of the golf clubhead of the present invention toy golf playset.

In accordance with an important aspect of the present invention set forth in FIG. 2 in greater detail, it should be noted that angled faces 14 and 15 of clubhead 13 form substantially equal angles and are each suitable for striking ball 40. Thus, golf club 10 is bidirectional and may be swung to impact ball 40 in either direction thereby facilitating use by both right-handed and left-handed children.

FIG. 2 sets forth a partial section view of golf club 10 showing shaft 12 extending downwardly to be secured to clubhead 13. As described above, clubhead 13 is preferably fabricated of a soft foam material or the like. Clubhead 13 defines an elongated cylindrical passage 16 which receives end 18 of shaft 12. As described above, clubhead 13 defines equally angled faces 14 and 15 diverging downwardly and outwardly to provide a pair of mirror image ball striking facets facilitating the use of golf club 10 by both right-handed and left-handed golfers. In its preferred form, clubhead 13 includes a support cradle 17 underlying at least a portion of clubhead 13 which is preferably formed of a somewhat more rigid plastic material or the like. Support cradle 17 provides a more secure attachment to end 18 of shaft 12 and provides some stability for clubhead 13 notwithstanding the soft resilient foam material from which clubhead 13 is fabricated. In addition, support cradle 17 is preferably fabricated of a somewhat more tough wear resistant material than the remainder of clubhead 13 and thus aids clubhead 13 in resisting the abrasive contact of clubhead 13 against play surface 20 as the child user swings golf club 10 toward ball 40 (seen in FIG. 1).

Figure 3:
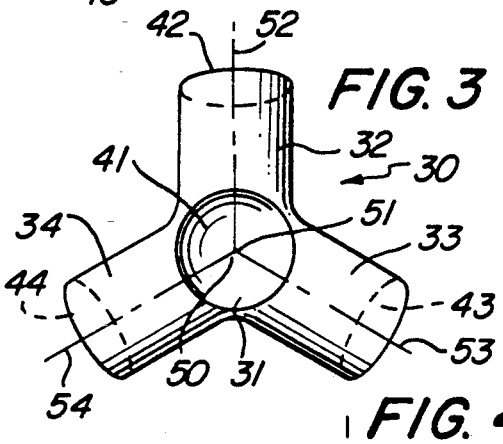
FIG. 3 sets forth a top view of the golf tee of the present invention toy golf playset.

FIG. 3 sets forth a top view of golf tee 30 with ball 40 removed. As described above, golf tee 40 comprises four generally cylindrical elements 31, 32, 33 and 34 defining respective center axes 51, 52, 53 and 54. Axes 51 through 54 intersect at a common point of intersection 50 about which golf tee 30 is generally symmetrical. Thus, axes 51 through 54 define equal interaxial angles between each axis and every other axis of golf tee 30. As a result, golf tee 30 inherently assumes the position in which tee 30 is supported by any three of elements 31 through 34 upon a play surface such that the remaining element extends vertically from the play surface. As a result, tee 30 is omnipositionable or independent of player placement upon the play surface in that it automatically assumes a ball supporting position in which three elements support the tee while the fourth extends vertically to receive ball 40. In its preferred form, tee 30 is fabricated of a soft resilient foam plastic material or the like for enhanced safety. Elements 31 through 34 each define respective concave ball recesses 41 through 44 respectively, each of which is properly configured to receive and support ball 40 in the manner shown in FIGS. 1 and 4.

Figure 4:
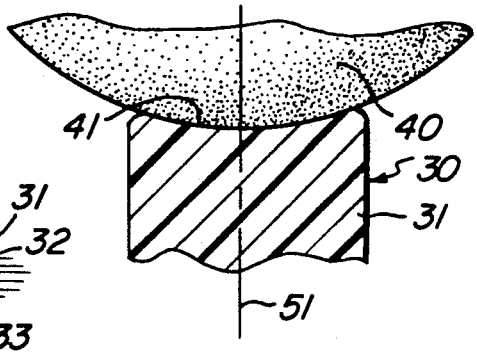
FIG. 4 sets forth a partial section view of the ball support upon the golf tee of the present invention toy golf playset.

FIG. 4 sets forth a section view of a typical tee element such as tee element 31 receiving and supporting ball 40. As described above, elements 31 through 34 are substantially cylindrical and define respective ball recesses. More specifically, element 31 defines a center axis 51 and a ball recess 41. Ball 40 is received within ball recess 41 and thus rests upon element 31. It will be apparent to those skilled in the art that element 31 is representative of identical elements 32 through 34. Accordingly, it will be equally well understood that elements 32 through 34 define corresponding ball recesses 42 through 44 identical to ball recess 41 which are equally able to support ball 40 in the manner shown in FIG. 4.

What has been shown is a toy golf playset suitable for use by extremely young children which provide entertaining and amusing play activities while maximizing safety and injury avoidance. The use of dual faceted golf clubhead and resilient foam material for both the handle and clubhead accommodates both right-handed and left-handed children and provides an increased measure of safety for the child user. Similarly, the use of an omnipositionable golf tee permits the child user to readily establish the tee position upon the play surface while facilitating the support of an enlarged soft resilient foam golf ball.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy golf playset comprising:

a golf club having an elongated shaft, a handle, and a clubhead, said clubhead being formed of a soft resilient foam material and defining a pair of mirror image angled ball striking surfaces to facilitate use of said golf club by both right-handed and left-handed players and a cradle extending beneath said angled ball striking surfaces;

a soft resilient foam ball; and a golf tee formed of a soft resilient material having four equal-length elements extending radially outwardly from a common center such that each forms equal angles with each remaining elements, each of said four elements of said golf tee each defining outwardly facing concave ball recesses.

2. A toy gold playset as set forth in claim 1 wherein said elements in said golf tee are generally cylindrical.

3. A toy golf playset as set forth in claim 2 wherein said elements in said golf tee are generally cylindrical.

* * * * *